United States Patent [19]

Lunn

[11] Patent Number: 4,976,479

[45] Date of Patent: Dec. 11, 1990

[54] DOORSTOP

[76] Inventor: Lawrence M. Lunn, 6125 U.S. Hwy. 31, S., Indianapolis, Ind. 46227

[21] Appl. No.: 315,818

[22] Filed: Feb. 27, 1989

[51] Int. Cl.[5] ..... E05C 17/54

[52] U.S. Cl. ..... 292/343; 292/DIG. 61

[58] Field of Search ..... 292/76, 77, 342, 343, 292/DIG. 61; 24/546, 579, 67.9

[56] References Cited

U.S. PATENT DOCUMENTS

| | | | |
|---|---|---|---|
| D. 33,424 | 10/1900 | Ballard . | |
| D. 52,825 | 12/1918 | Leach . | |
| 281,504 | 7/1883 | Hazen et al. | 292/343 |
| 435,226 | 8/1890 | Imler . | |
| 535,507 | 3/1895 | McGrory . | |
| 628,366 | 7/1899 | Sponsel . | |
| 652,659 | 6/1900 | Blackwell | 292/343 |
| 700,324 | 5/1902 | Gray . | |
| 1,064,760 | 6/1913 | Nielsen . | |
| 1,149,078 | 8/1915 | Otte . | |
| 1,352,456 | 9/1920 | Guynn | 292/342 |
| 1,555,129 | 9/1925 | Lipsius . | |
| 1,599,595 | 9/1926 | Sponsel . | |
| 1,633,202 | 6/1927 | Williams . | |
| 1,833,773 | 11/1931 | Brooks . | |
| 1,879,664 | 9/1932 | Eaton . | |
| 1,935,252 | 11/1933 | Spratt et al. | 292/343 |
| 2,487,427 | 11/1949 | Drake et al. | 292/343 |
| 2,507,967 | 5/1950 | Forester et al. | 292/343 |
| 2,518,385 | 8/1950 | Shann | 292/19 |
| 2,703,728 | 3/1955 | Raber | 292/288 |
| 2,784,443 | 3/1957 | Von Berg | 16/85 |
| 3,054,632 | 9/1962 | Welch | 292/288 |
| 4,044,424 | 8/1977 | Sasgen | 16/85 |
| 4,705,309 | 11/1987 | Sawchuk | 292/342 |

FOREIGN PATENT DOCUMENTS 263600 12/1949 Switzerland .

*Primary Examiner*—Gary L. Smith
*Assistant Examiner*—Michael Miland
*Attorney, Agent, or Firm*—Michael N. Meller

[57] ABSTRACT

A resilient doorstop may be inexpensively manufactured to provide a door-engaging portion and a base portion interconnected with two or more serially connect, long, straight lengths of rod layer transverse to the door-engaging portion and having a length sufficient that the door-engaging portion may be substantially deformed in the direction of the base portion without exceeding the elastic limit of the rod. The resilient doorstep is preferably formed from a single, resilient, bent rod and includes a U-shaped portion with a central axis laying transverse to the central axis of the door-engaging portion to provide one or more long straight lenghts of rod, permitting deformation of the door-engaging portion toward the base portion through torsional deformation and urging the door-engaging portion away from the base portion through torsional resilience. The base portion may be a large U-shaped portion at one end of the rod, and the door-engaging portion may be a smaller U-shaped portion at the other end of the rod that is positioned to be concentric with the larger, U-shaped, base portion so that the smaller door-engaging portion may be deformed into substantially the same plane as the base portion, thereby permitting the doorstop to be inserted into a space between the door and the floor that is only slightly greater than the thickness of the rod from which the doorstop is formed.

16 Claims, 2 Drawing Sheets

DOORSTOP

TECHNICAL FIELD

This invention relates to resilient doorstops and, more particularly, to doorstops that may be formed from a single, resilient, bent rod.

BACKGROUND ART

Resilient stops for doors and windows are well known. Among the patents showing doorstops and retainers formed from a single flat metal strap are U.S. Pat. Nos. 1,064,760; 1,149,078; 1,879,664; and 4,044,424; and Design Pat. Nos. 33,424 and 52,825. Each of these patents shows a doorstop and retainer formed from a single, bent, metal strap. U.S. Pat. Nos. 700,324 and 2,507,967 show sash and window holders also formed from a single flat metal strap. The foregoing patents generally disclose doorstops and window stops which use the resilience of the bent metal strap to retain a door or window against movement. Doorstops including a plurality of parts and, in many instances, resilient portions to retain a door are shown, for example, in U.S. Pat. Nos. 435,226; 1,555,129; 1,633,202; 1,833,773; 1,935,252; 2,487,427; 2,703,728; 2,784,443; 3,054,632; and 4,705,309; and Swiss Pat. No. 263,600.

Doorstops formed from a single bent wire or rod are disclosed, for example, in U.S. Pat. Nos. 535,507; 628,366; 1,599,595; and 1,833,773. U.S. Pat. Nos. 628,366; 1,599,595; and 1,833,773 show resilient, bent-rod doorstops, including base portions and door-engaging portions urged away from the base portions, and disclose that such doorstops may be deformed, positioned between the bottom of a door and the adjacent floor, and released to engage, through their resilience, the door and the floor and to retain the door in position.

The prior doorstops are relatively difficult and expensive to manufacture because of their complex shapes, their pluralities of parts, the expense of manufacturing individual parts and joining them together into operable doorstops, and the cost of the punching, stamping, and bending tooling that is required to form and bend their complexly shaped portions. In addition, the prior doorstops may include resilient portions which either fail to provide substantial deformation or fail to sufficiently recover from substantial deformation and provide a resilient holding force.

DISCLOSURE OF INVENTION

My invention provides a resilient doorstop that may be inexpensively manufactured to provide a door-engaging portion and a base portion interconnected with two or more serially connected, long, straight lengths of rod that lay transverse to the door-engaging portion and have sufficient length that the door-engaging portion may be substantially deformed in the direction of the base portion without exceeding the elastic limit of the rod. In a preferred embodiment, the resilient doorstop is formed from a single, resilient, bent rod and includes a U-shaped portion with a central axis laying transverse to the central axis of the door-engaging portion to provide one or more long straight lengths of rod that permit deformation of the door-engaging portion toward the base portion through their torsional deformation and urge the door-engaging portion away from the base portion with their torsional resilience. In a specific preferred embodiment of the invention, the base portion is provided by a large U-shaped portion at one end of the rod; and the door-engaging portion is provided by a smaller U-shaped portion at the other end of the rod, with these two portions being interconnected with an intervening U-shaped portion that positions the smaller, U-shaped, door-engaging portion to be concentric with the larger, U-shaped, base portion so that the smaller door-engaging portion may be deformed into substantially the same plane as the base portion without exceeding the elastic limit of the rod, thereby permitting the doorstop to be inserted into a space between the door and the floor that is only slightly greater than the thickness of the rod from which the doorstop is formed. The doorstop of the invention may be coated with a material providing high frictional resistance to slippage.

Further features and advantages of the invention will become apparent from an examination of the drawings and the detailed description of the particularly preferred embodiment that follow.

BEST MODE FOR CARRYING OUT THE INVENTION

Figure 4:
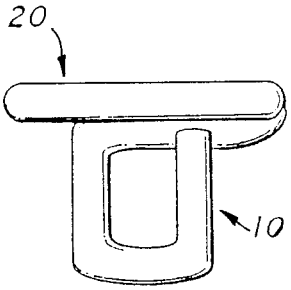
FIG. 4 is a view from the rear of the doorstop of FIG. 1.
Figure 3:
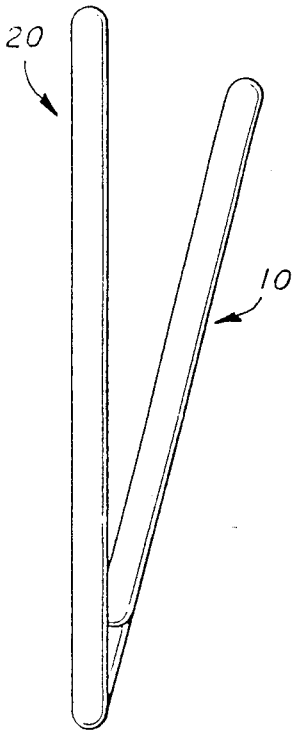
FIG. 3 is a view from the left of the doorstop of FIG. 1.
Figure 1:
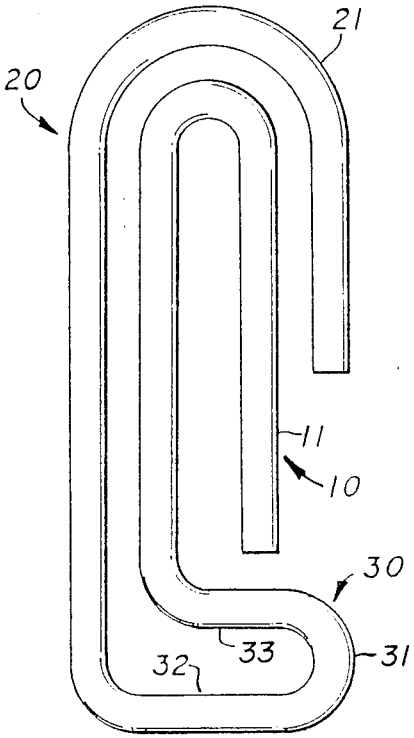
FIG. 1 is a top view of the doorstop of my invention.
Figure 2:
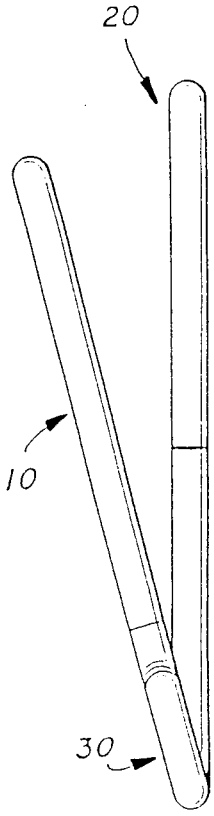
FIG. 2 is a view from the right of the doorstop of FIG. 1.
Figure 5:
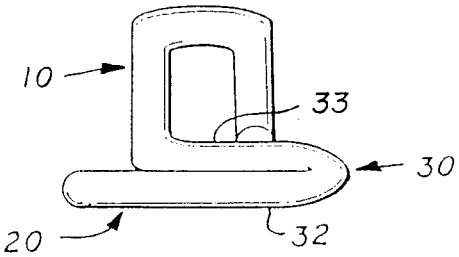
FIG. 5 is a view from the front of the doorstop of FIG. 1.

As shown in FIG. 1, a doorstop of my invention includes a door-engaging portion 10, a base portion 20, and an interconnecting portion 30. The entire doorstop may be and is preferably formed from a single length of rod or wire bent in such a manner that base portion 20 and door-engaging portion 10 are urged away from one another.

Figure 6:
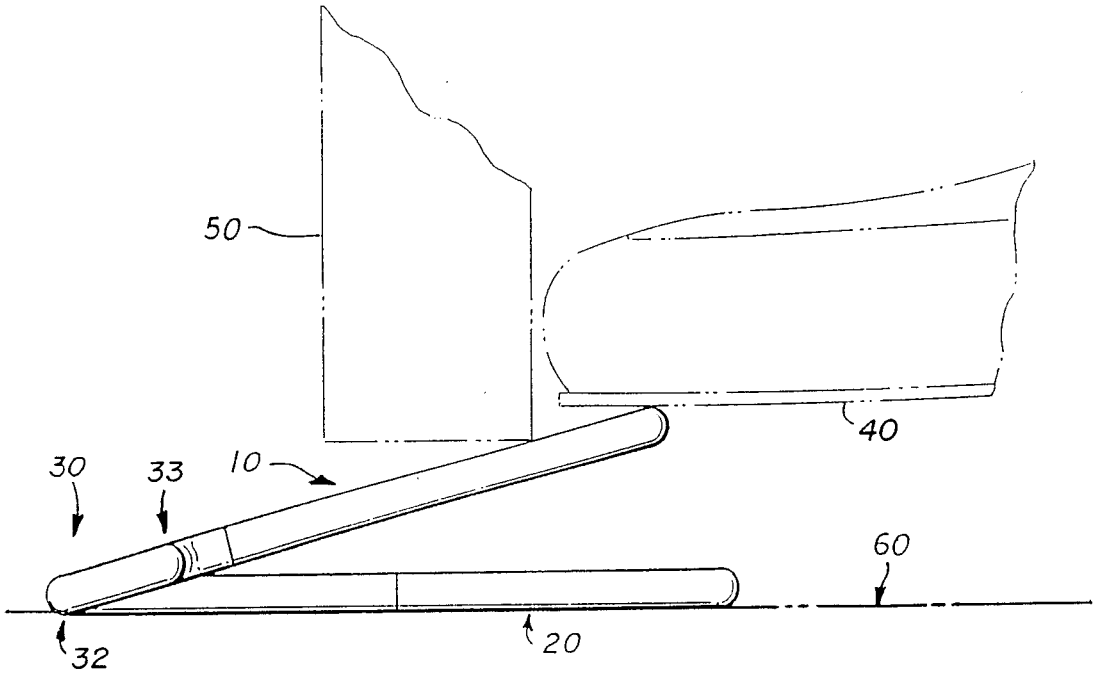
FIG. 6 is a drawing of the doorstop of FIG. 1 showing its use.

As shown in FIG. 6, in the use of the doorstop, the doorstop may be placed on the floor 60 with base portion 20 resting on the floor 60 and door-engaging portion 10 extending upwardly from the floor 60. Door-engaging portion 10 may be deformed or pressed in the direction of base portion 20, as, for example, by a foot 40 of a user; and a door 50 to be stopped may then be positioned over door-engaging portion 10. Door-engaging portion 10 may then be released so that the resilience of the doorstop provides a force between door 50 and floor 60 to hold the door in place.

As shown in FIG. 1, door-engaging portion 10 is preferably a small, narrow, U-shaped portion 11 formed in one end of the rod; and base portion 20 is preferably a larger, wider, U-shaped portion 21 formed in the other end of the rod. As shown in FIG. 1, U-shaped, base portion 21 and U-shaped, door-engaging portion 11 are preferably generally concentric. It is preferable that base portion 20 and door-engaging portion 10 be formed and positioned with respect to each other in such a manner that door-engaging portion 10 may be depressed into substantially the same plane as base portion 20 without interference between base portion 20 and door-engaging portion 10. Such an arrangement permits the doorstop to be used with doors having small clearances above the floor, clearances only slightly greater than the thickness of the material from which the doorstop is formed. Although the preferable doorstop is more easily manufactured with base portion 20 and door-engaging portion 10 having concentric U-shapes, as shown in FIG. 1, base portion 20 and door-engaging portion 10 can be other shapes and forms and can be arranged in other than a concentric fashion to achieve beneficial operation.

In the invention, my resilient doorstop is provided with at least two, and preferably two or more, serially connected straight lengths of rod laying transverse to door-engaging portion 10 and urging door-engaging portion 10 away from base portion 20 through torsional deformation and resilience. The two or more lengths are sufficiently long that door-engaging portion 10 may be depressed in the direction of base portion 20 substantially into the plane of the base portion without exceeding the elastic limit of the rod or wire, thereby maintaining the resilience of the doorstop and its effective operability.

As shown in FIG. 1, door-engaging portion 10 and base portion 20 are connected together with interconnecting portion 30. Interconnecting portion 30 preferably has a U-shaped portion 31. U-shaped portion 31 provides two or more straight lengths 32, 33 of rod laying transverse to door-engaging portion 10. The central axis of U-shaped portion 31, in this preferred embodiment, is not only transverse to the central axis of door-engaging portion 10, but lays substantially at right angles of the central axis of door-engaging portion 10.

As shown in FIG. 6, in the use of the doorstop of my invention, two or more serially connected, long, straight lengths 32, 33 of rod forming the U-shaped portion are deformed by torsion as door-engaging portion 10 is pressed in the direction of base portion 20. The two or more serially connected, long, straight lengths 32, 33 of rod have sufficient length that the substantial deformation, including deformation of door-engaging portion 10 into substantially the plane of base portion 20, does not exceed the elastic limit of the rod from which the doorstop is formed; and through the resilience of the material from which the rod is made, door-engaging portion 10 is urged to return to its original position, thereby exerting a force between floor 60 and door 50. Importantly, because the two or more serially connected lengths 32, 33 of wire are sufficiently long that the elastic limit of material from which the doorstop is made is not exceeded, the doorstop does not take a "set" in use. In my invention, the material from which the doorstop may be made can be any material that can be processed to provide significant force in its resilience from deformation.

In the specific embodiment of my invention shown in the figures, the rod or wire from which the doorstop is formed is generally a good grade of tempered cold-rolled steel having a diameter of about one-quarter inch (0.64 cm). The rod is formed into base portion 20 having a length of about five inches (12.7 cm) and door-engaging portion 10 having a length of about four and one-half inches (11.4 cm). Door-engaging portion 10 raises about one and one-quarter inches (3.2 cm) above base portion 20. The base portion and door-engaging portion are interconnected by a long straight length 32 of rod having a straight length of one and one-quarter to one and one-half inches (3.2 cm to 3.6 cm). U-shaped portion 31 interconnecting base portion 20 and door-engaging portion 10 also provides a shorter straight length 33 having a length of three-quarters to one inch (1.9 cm to 2.5 cm). As shown in the figures, the longer and shorter straight lengths 32, 33 of rod form a U-shaped portion having its central axis at right angles to the axis of the U formed by door-engaging portion 10. The two or more serially connected, long, straight lengths 32, 33 of rod making up U-shaped interconnection portion 31 and laying transverse to the door-engaging portion are spaced about three-quarters of an inch (1.9 cm) from center to center. The legs of the U-shaped door-engaging portion are likewise spaced to about three-quarters of an inch (1.9 cm) center to center. The lengths of the legs forming the U-shaped based portion are spaced about one and seven-eighths inches (4.8 cm) center to center.

In preferred embodiments of my invention, the doorstop is coated with a coating having a high coefficient of friction and, preferably, elastomeric qualities. I have found a preferred coating to be a heavy coating of plastisol that may be applied to the bent rod by fluidized bed methods, dipping, spraying, or any other common coating means.

As is apparent from the above description, door-stops having shapes other than the preferred embodiment described above may be made using my invention without departing from the scope of the claims that follow.

I claim:

1. In a doorstop formed from a single, resilient, bent rod, including an upwardly urged, door-engaging portion and a base portion, the improvement wherein only a single U-shaped portion is located between the door-engaging portion and the base portion with its central axis laying transverse to the central axis of the door-engaging portion, wherein the single U-shaped portion forms the only transition between the door-engaging portion and base portion.

2. The doorstop of claim 1 wherein the central axis of the U-shaped portion lays at right angles to the central axis of the door-engaging portion.

3. The doorstop of claim 1 wherein the door-engaging portion is formed as a flat narrow U, the base portion is formed as a flat wide U, and the U-shaped portion lays between and interconnects the narrow door-engaging U and wide base U and permits the resilient deformation of the door-engaging U into substantially the plane of the base U.

4. The doorstop of claim 1 wherein each of said door-engaging and base portions lie entirely in respectively different planes and the door-engaging portion is substantially concentric with and smaller than the base portion.

5. The doorstop of claim 1 wherein the U-shaped portion includes two straight legs with sufficient length to be substantially deformable in torsion without exceeding their elastic limit.

6. The doorstop of claim 1 wherein the U-shaped portion forms the only transition between the door-engaging portion and base portion and its central axis lies at right angles to the axes of the door-engaging and base portions.

7. The doorstop of claim 1 including a coating with a high coefficient of friction.

8. The doorstop of claim 7 wherein the coating is elastomeric.

9. In a resilient doorstop including a door-engaging portion and a base portion, the improvement comprising only two serially connected straight lengths of rod laying transverse to the door-engaging portion, said two lengths being sufficiently long that the door-engaging portion may be substantially deformed in the direction of the base portion without exceeding the elastic limit in said rod, wherein said two serially connected straight lengths of rad are interconnected to form a single U-shaped deformable portion of the door stop and the resilient doorstop is formed from a single bent rod and the single U-shaped portion forms the only transition between the door-engaging portion and the base portion.

10. The doorstop of claim 9 wherein the central axis of the U-shaped portion lays at right angles to the central axis of the door-engaging portion.

11. The doorstop of claim 9 wherein the door-engaging portion is formed as a narrow U, the base portion is formed as a wide single U, and the U-shaped portion lays between and interconnects the narrow door-engaging U and wide base U.

12. The doorstop of claim 11 wherein the door-engaging portion is concentric with and smaller than the base portion.

13. The doorstop of claim 9 including a coating with a high coefficient of friction.

14. The doorstop of claim 13 wherein the coating is elastomeric.

15. A doorstop, comprising a single length of bent wire including a wide, U-shaped, base portion and a narrow, U-shaped, door-engaging portion interconnected with only two serially connected, straight wire portions transverse to said door-engaging and base portions, said two straight wire portions providing two resilient sections urging said door-engaging portion away from said base portion through their torsional deformation and resilience and being sufficiently long that deformation of said door-engaging portion to about the plane of said base portion may be made without exceeding the elastic limit in said two resilient sections, wherein said two straight wire portions are interconnected to form a single U-shaped portion lying at right angles to the central axis of the door-engaging and base portions, and the single U-shaped portion forms the only transition between the door-engaging portion and base portion.

16. The doorstop of claim 15 wherein the door-engaging portion is concentric with and smaller than the base portion, permitting deformation of the door-engaging portion substantially into the plane of the base portion to permit the doorstop to be inserted into a space between the floor and the door only slightly greater than the thickness of the wire.

* * * * *